US006688865B1

(12) United States Patent
Matsumoto et al.

(10) Patent No.: US 6,688,865 B1
(45) Date of Patent: Feb. 10, 2004

(54) VANE TYPE FLUID MACHINERY HAVING A DEFORMABLE SEAL PORTION ON THE VANE

(75) Inventors: Kenji Matsumoto, Wako (JP); Yasunobu Kawakami, Wako (JP); Kensuke Honma, Wako (JP); Toshihiro Tsutsui, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/111,394

(22) PCT Filed: Nov. 2, 2000

(86) PCT No.: PCT/JP00/07739

§ 371 (c)(1),
(2), (4) Date: Aug. 30, 2002

(87) PCT Pub. No.: WO01/33082

PCT Pub. Date: May 10, 2001

(30) Foreign Application Priority Data

Nov. 4, 1999 (JP) ..... 11-313485

(51) Int. Cl.[7] ..... F01C 1/344
(52) U.S. Cl. ..... 418/145; 418/178
(58) Field of Search ..... 418/145–148, 418/178

(56) References Cited

U.S. PATENT DOCUMENTS 747,418 A * 12/1903 D'Halewyn ..... 418/146
1,269,937 A * 6/1918 Hutsell ..... 418/147
2,193,178 A * 3/1940 Laythorpe ..... 418/146
2,623,365 A * 12/1952 Daniel ..... 418/146
3,452,725 A * 7/1969 Kelly ..... 418/147
3,976,403 A * 8/1976 Jensen ..... 418/147
5,672,054 A * 9/1997 Cooper et al. ..... 418/178

FOREIGN PATENT DOCUMENTS

| | | | |
|---|---|---|---|
| DE | 1246338 | * 8/1967 | ..... 418/178 |
| EP | 0158064 | * 10/1985 | |
| JP | 59-1896 | 1/1984 | |
| JP | 1-134087 | 5/1989 | |
| JP | 1-224490 | 9/1989 | |
| JP | 10-53870 | 2/1998 | |

* cited by examiner

*Primary Examiner*—John J. Vrablik

(74) *Attorney, Agent, or Firm*—Arent Fox Kintner Plotkin & Kahn, PLLC

(57) ABSTRACT

A vane type fluid machine includes: a casing; a rotor rotating in the casing; and a plurality of vanes supported by the rotor to slide on an inner surface of the casing. A seal portion of each vane is formed to be elastically deformable so as to slide on the inner surface of the casing while bending backward of a rotational direction of the rotor. Therefore, an improved structure of the seal portion of each vane secures good sealing performance even if machining accuracy of the inner surface of the casing is alleviated.

8 Claims, 17 Drawing Sheets

VANE TYPE FLUID MACHINERY HAVING A DEFORMABLE SEAL PORTION ON THE VANE

FIELD OF THE INVENTION

The present invention relates to a vane type fluid machine, and particularly to an improvement in a vane type fluid machine having a casing, a rotor rotating in the casing, and a plurality of vanes supported by the rotor to slide on an inner surface of the casing.

BACKGROUND ART

The applicant has suggested a fluid machine of this type in which a rotor chamber substantially in the form of an athletic track in a phantom plane including a rotation axis of a rotor is provided in a two-divided casing, and a substantially U-shaped seal portion of each vane slides on an inner surface of the rotor chamber (see the specification and drawings of Japanese Patent Application No. 11-57933).

In this case, when a minute recess and projection or a minute step due to a deviation between mating surfaces of the casing exists on the inner surface of the rotor chamber, sealing performance between the inner surface of the rotor chamber and the seal portion is impaired since the seal portion is made of hard PTFE (polytetrafluoroethylene) and cannot be deformed to fit the minute recess and projection or the like.

Thus, the inner surface of the rotor chamber must be micromachined, but the rotor chamber has a specific shape as described above, and therefore, a long time is required for its micromachining, thereby causing an increase in cost of the fluid machine.

DISCLOSURE OF THE INVENTION

The present invention has an object to provide a vane type fluid machine in which an improved structure of a seal portion of each vane can secure good sealing performance even if machining accuracy of an inner surface of a casing is alleviated.

To achieve the first object, according to the present invention, there is provided a vane type fluid machine including: a casing; a rotor rotating in the casing; and a plurality of vanes supported by the rotor to slide on an inner surface of the casing, wherein a seal portion of each vane is formed to be elastically deformable so as to slide on the inner surface of the casing with the seal portion bent backward of a rotational direction of the rotor.

Forming the seal portion of each vane as described above allows the seal portion to be elastically deformed to fit shapes of a minute recess and projection or a minute step, even if they exist on the inner surface of the casing, so that sealing performance between the seal portion and the inner surface of the casing can be secured to allow alleviation in machining accuracy of the inner surface of the casing.

When a surface pressure of the seal portion is increased by a centrifugal force accompanying high speed rotation of the rotor, a heating value due to sliding is increased to impair durability of the seal portion. Such occurrence of defects are automatically avoided by actions mentioned below. Specifically, during high speed rotation of the rotor, a kinetic pressure in a wedge-shaped space formed between a front surface of the seal portion in a rotational direction of the rotor and the inner surface of the casing is increased, and the kinetic pressure is further increased by an increased amount of deformation of the seal portion by the centrifugal force. The increased kinetic pressure becomes a pressing force of the seal portion on the inner surface of the casing, and a pressure acting on a tip of the seal portion is reduced since a point of application of the pressing force is displaced closer to a base rather than the tip of the seal portion by deformation thereof. This restrains an increase in the surface pressure of the seal portion, and reduces the heating value due to sliding to significantly improve durability of the seal portion. When a value of the kinetic pressure in the wedge-shaped space is higher than a design value, the seal portion is significantly deformed to release an excess of the kinetic pressure, thereby keeping the kinetic pressure in the wedge-shaped space substantially constant.

BEST MODE FOR CARRYING OUT THE INVENTION

Figure 1:
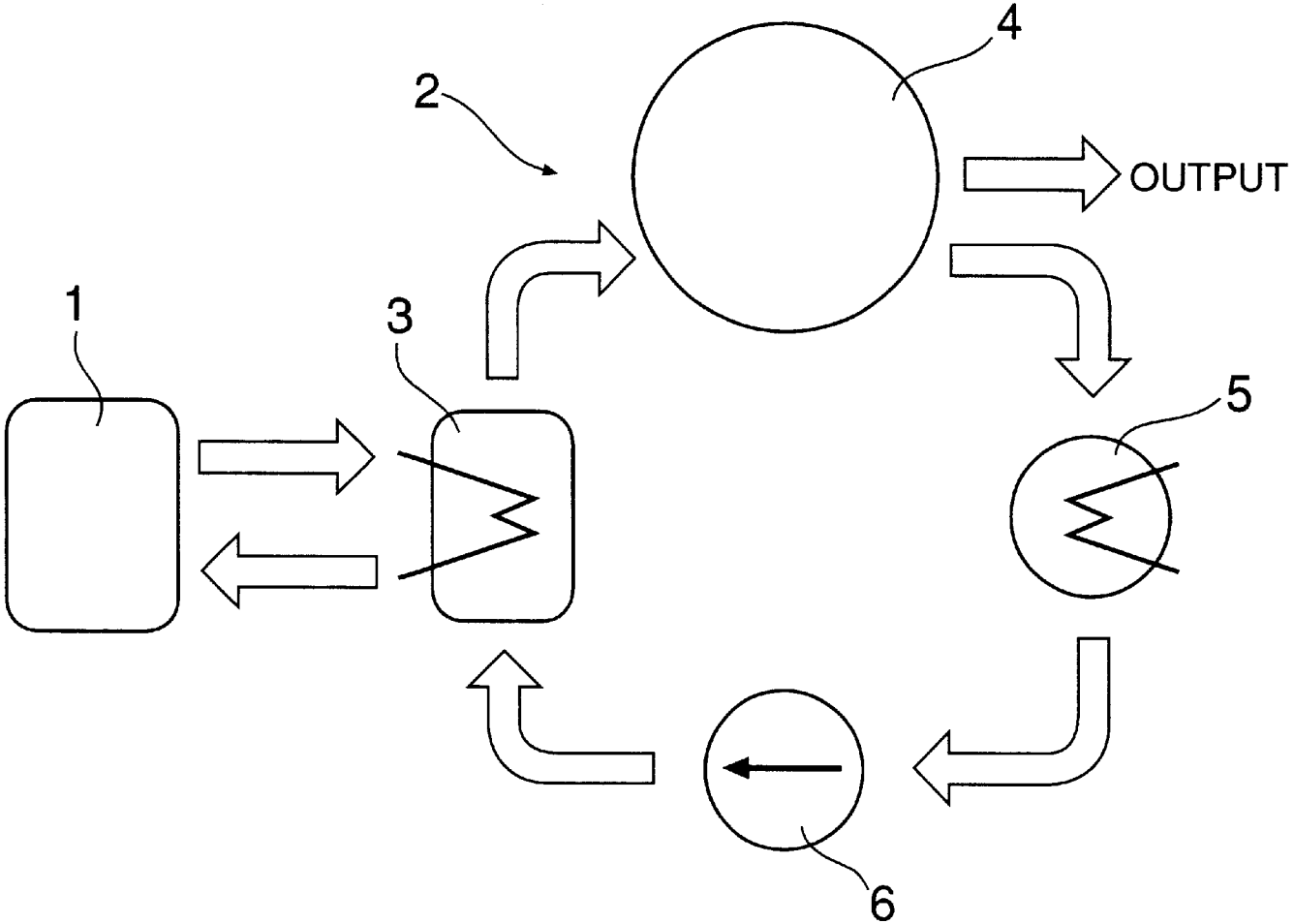
FIG. 1 is a schematic view of a waste heat recovering device for an internal combustion engine.

In FIG. 1, a waste heat recovering device 2 of an internal combustion engine 1 comprises an evaporator 3 for generating vapor with a raised temperature and a raised pressure, that is, a raised-temperature/pressure vapor as fluid, using waste heat, for example, the exhaust gas of the internal combustion engine 1 as a heat source; an expander 4 as a vane type fluid machine for generating an output by expansion of the raised temperature/pressure vapor; a condenser 5 for liquefying the vapor, which is discharged from the expander 4, with a dropped temperature and a dropped pressure after the expansion, that is, a dropped-temperature/pressure vapor; and a supply pump 6 for supplying liquid, for example, water, from the condenser 5 to the evaporator 3.

The expander 4 has a specific structure and is formed as follows.

In FIGS. 2 to 5, a casing 7 comprises first and second half bodies 8, 9 made of metal. Each of the half bodies 8, 9 comprises a main body 11 having a substantially oval recess 10 and a circular flange 12 integral with the main body 11, and the circular flanges 12 are superposed via a metal gasket 13 to form a substantially oval rotor chamber 14. An outer surface of the main body 11 of the first half body 8 is covered with a main body 16, in the form of a deep bowl, of a shell-shaped member 15, a circular flange 17 integral with the main body 16 is superposed on the circular flange 12 of the first half body 8 via a gasket 18, and three circular flanges 12, 12, 17 are fastened by a bolt 19 at a plurality of circumferential positions. An expansion chamber 20 is thereby formed between the main bodies 11, 16 of the shell-shaped member 15 and the first half body 8.

The main bodies 11 of the half bodies 8, 9 have hollow shaft receiving tubes 21, 22 projecting outwards at their outer surfaces, and by the hollow shaft receiving tubes 21 22, a large diameter portion 24 of a hollow output shaft 23 penetrating the rotor chamber 14 is turnably supported via a bearing metal 25. An axis L of the output shaft 23 thereby passes an intersection point of a long diameter and a short diameter in the substantially oval rotor chamber 14. A small diameter portion 26 of the output shaft 23 projects outwards beyond a hole 27 at the hollow shaft receiving tube 22 of the second half body 9 and is connected to a transmission shaft 28 via spline coupling 29. The small diameter portion 26 and the hole 27 are sealed by two seal rings 30.

Accommodated in the rotor chamber 14 is a circular rotor 31, and a shaft mounting hole 32 at its center is in a fitted relationship to the large diameter portion 24 of the output shaft 23 to provide an engagement portion 33 between the two 31, 24. A rotation axis of the rotor 31 thereby matches the axis L of the output shaft 23, thus "L" is commonly used as reference character of the rotation axis.

The rotor 31 is formed with a plurality of, in this embodiment twelve, slot-shaped spaces 34 radially extending from the shaft mounting hole 32 about the rotation axis L at even intervals on the circumference. Each space 34 is circumferentially narrow and in substantially U-shape in a phantom plane perpendicular to both end surfaces 35 so as to sequentially open into the both end surfaces 35 and an outer peripheral surface 36 of the rotor 31.

In the respective slot-shaped spaces 34, first to twelfth vane-piston units U1–U12 with the same structure are mounted so as to freely reciprocate in the respective radial direction as follows. The space 34 of substantially U-shape is formed with a stepped hole 38 at a portion 37 comparting the inner peripheral side of the space 34, and a stepped cylinder member 39 made of ceramic is fitted in the stepped hole 38. An end surface of a small diameter portion a of the cylinder member 39 abuts against an outer peripheral surface of the large diameter portion 24 of the output shaft 23, and a small diameter hole b thereof communicates with a through-hole c opening into the outer peripheral surface of the large diameter portion 24. A guide tube 40 is disposed outside the cylinder member 39 so as to be positioned coaxially with the member 39. An outer end of the guide tube 40 is locked by an opening of the space 34 on the outer peripheral surface of the rotor 31, and an inner end of the guide tube 40 is fitted in a large diameter hole d of the stepped hole 38 to abut against the cylinder member 39. The guide tube 40 has a pair of slots e extending from its outer end to around its inner end in an opposed manner, and both of the slots e face the space 34. A piston 41 made of ceramic is slidably fitted in a large diameter cylinder hole f of the cylinder member 39, and a tip side of the piston 41 is always positioned in the guide tube 40.

Figure 2:
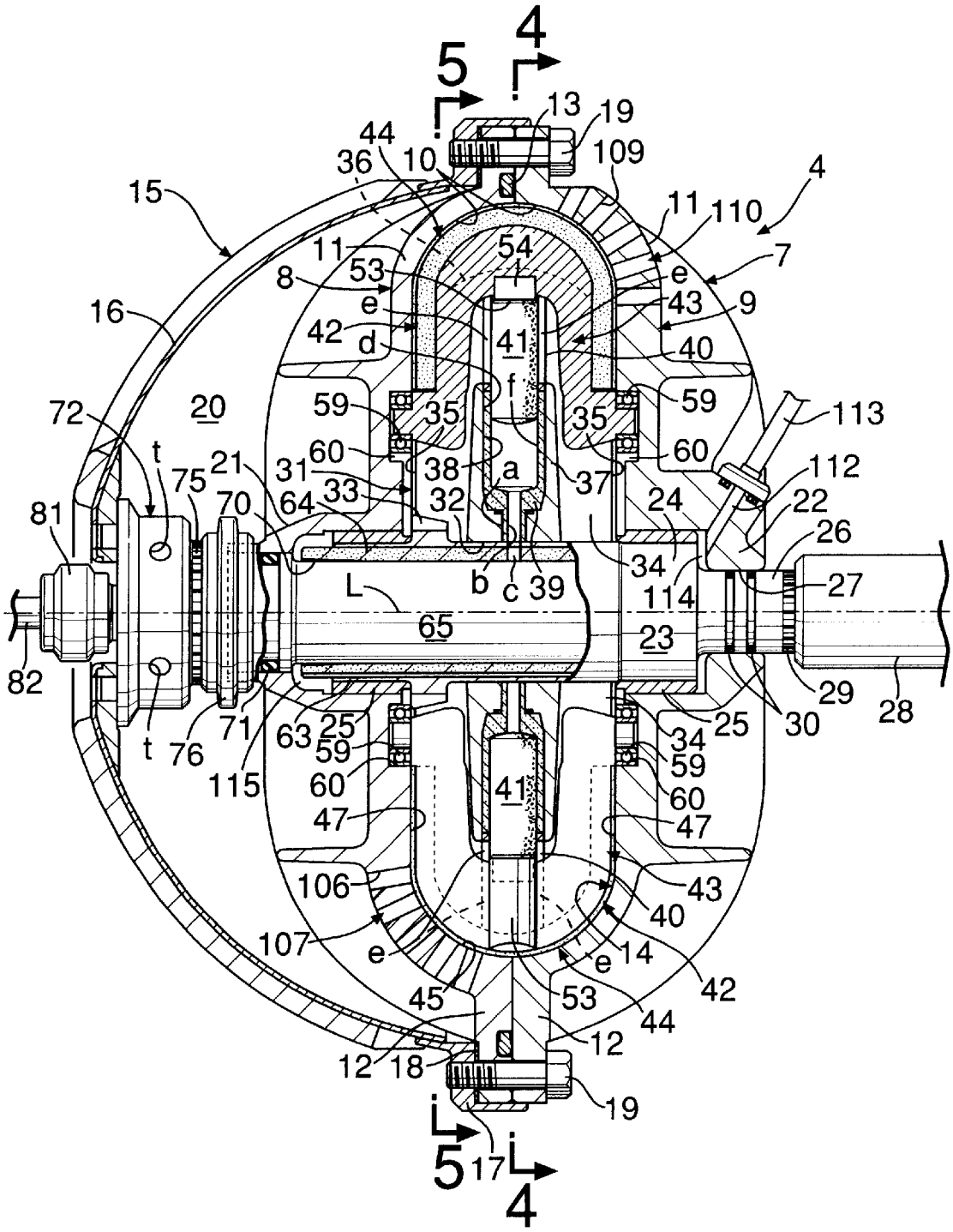
FIG. 2 is a vertical sectional view of an expander and is a sectional view taken along a line 2—2 in FIG. 5.
Figure 6:
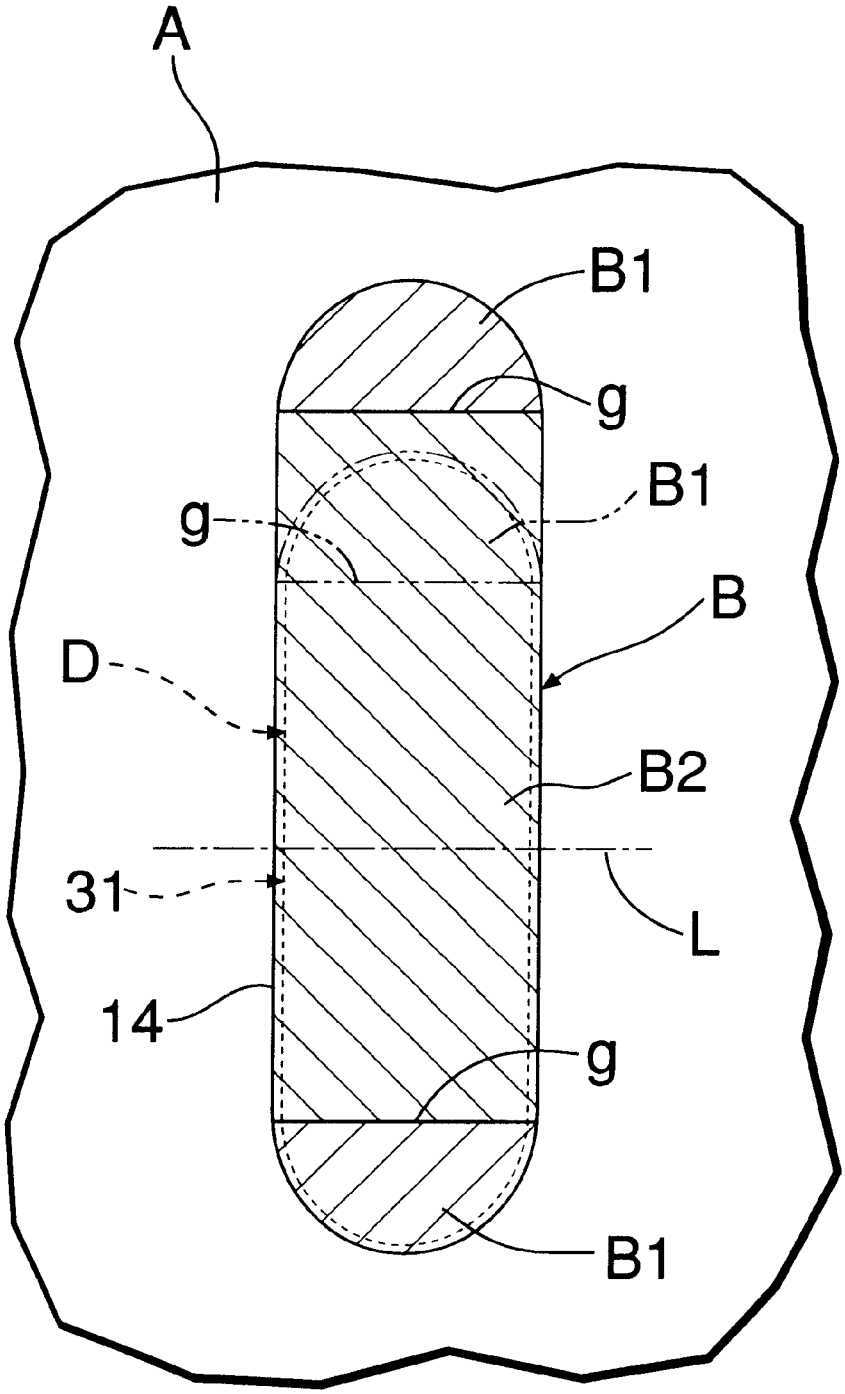
FIG. 6 is an explanatory view showing sectional configurations of a rotor chamber and a rotor.
Figure 7:
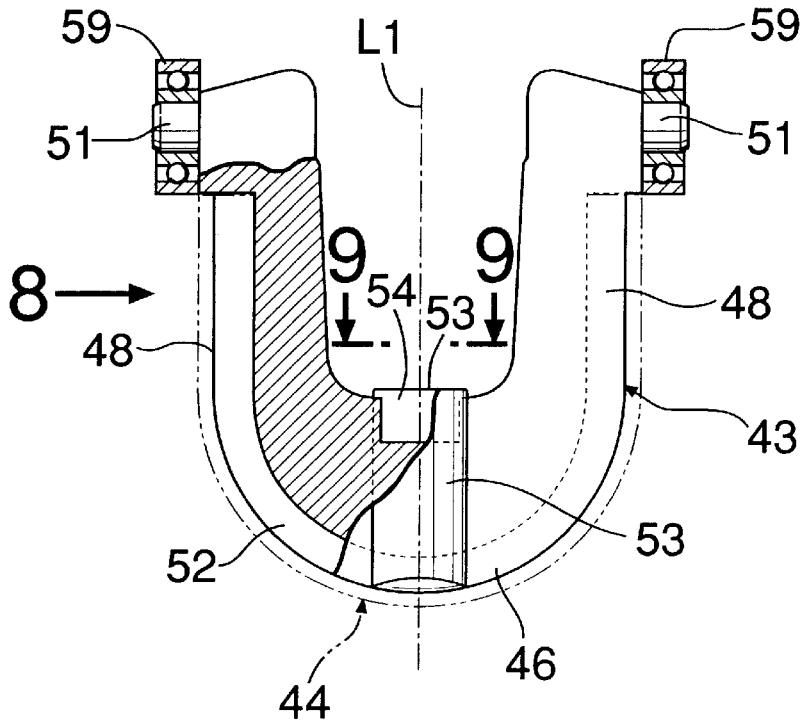
FIG. 7 is a front view of a vane body.
Figure 8:
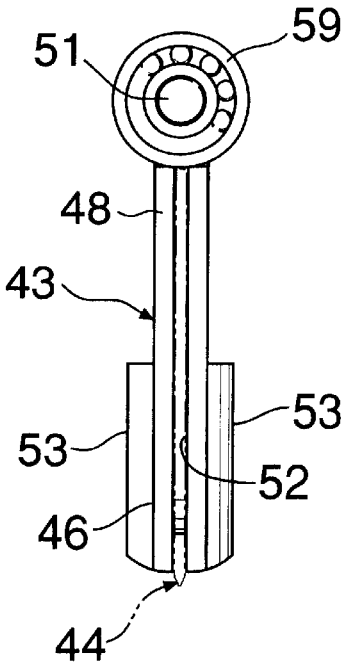
FIG. 8 is a view taken in the direction of an arrow 8 in FIG. 7.
Figure 9:
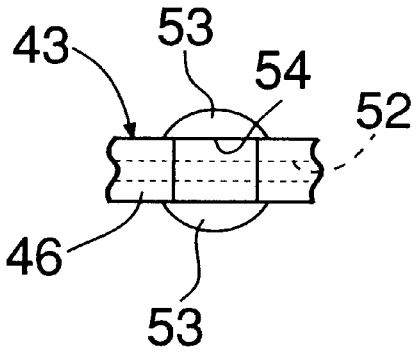
FIG. 9 is a sectional view taken along a line 9—9 in FIG. 7.
Figure 10:
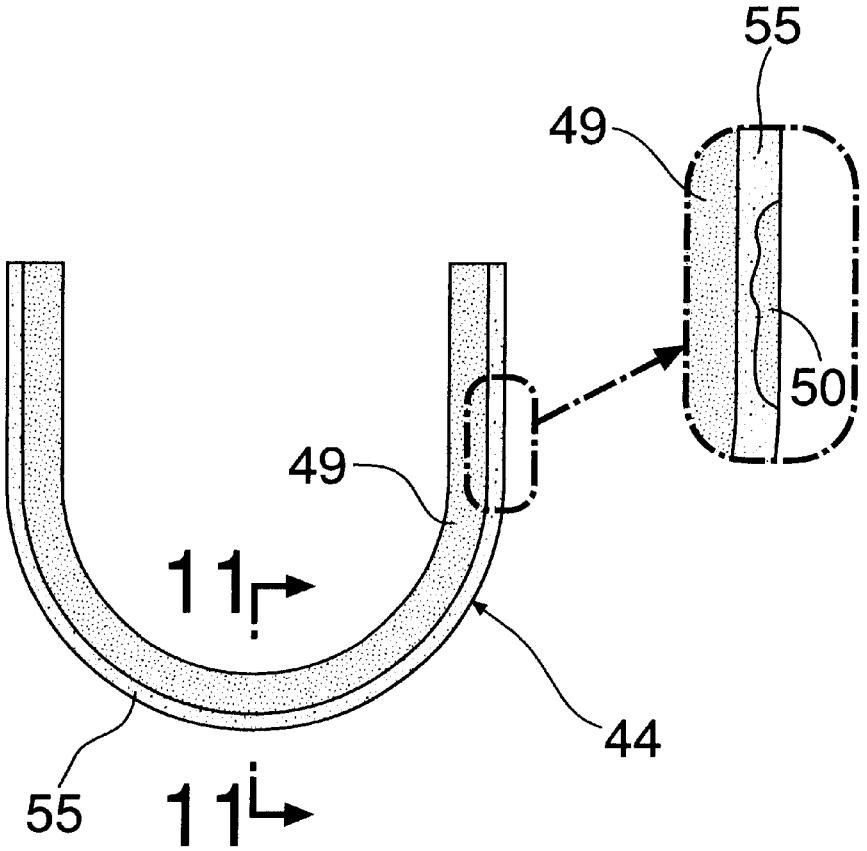
FIG. 10 is a front view, partially enlarged and cutaway, of a seal member.
Figure 11:
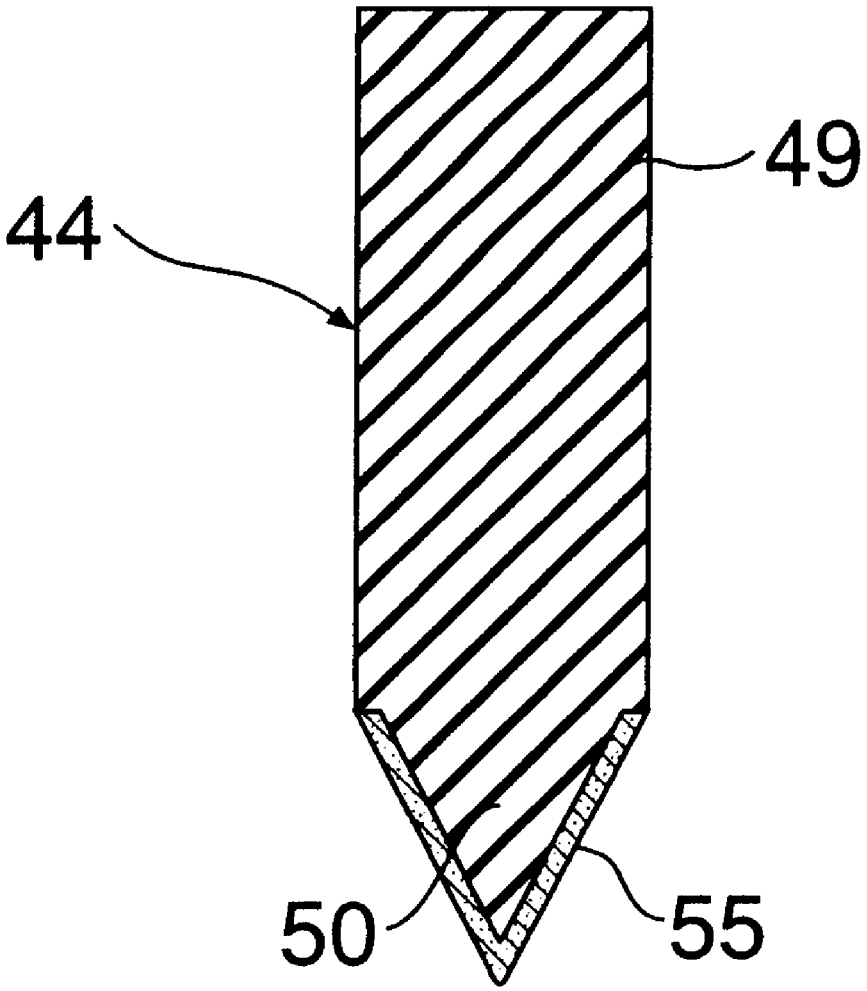
FIG. 11 is an enlarged sectional view taken along a line 11—11 in FIG. 10.

As shown in FIGS. 2 and 6, a section B of the rotor chamber 14 in a phantom plane A including the rotation axis L of the rotor 31 is formed of a pair of semi-circular sections B1 with their diameters g opposed to each other and a rectangular section B2 formed by connecting opposed one ends of the diameters g of the semi-circular sections B1 to each other and opposed other ends of the diameters g to each other, respectively, and is substantially in the form of an athletic track. In FIG. 6, a part illustrated by a solid line shows the largest section including the long diameter, while a part partially illustrated by a double-dotted chain line shows the smallest section including the short diameter. The rotor 31 has a section D slightly smaller than the smallest section including the short diameter of the rotor chamber 14, as shown by a dotted line in FIG. 6.

As is clearly shown in FIGS. 2, 5, 7 to 11, a vane 42 comprises a vane body 43 in the form of substantially U-shaped plate, and a seal member 44 in the form of substantially U-shaped plate mounted to the vane body 43.

The vane body 43 has semi-circular arcuate portions 46 opposed at a predetermined interval in an inner peripheral surface 45 by the semi-circular section B1 of the rotor chamber 14, and a pair of parallel portions 48 opposed at a predetermined interval in opposed inner end surfaces 47 by the rectangular section B2. Each parallel portion 48 is provided, at its end side, with a short shaft 51 protruding outwards, outer peripheral portions of the semi-circular arcuate portion 46 and both parallel portions 48 are sequentially formed with U-shaped grooves 52 opening outwards, and further, both plane parts of the semi-circular arduate portion 46 are respectively provided with a pair of projecting strips 53 having broken circular sections. Both of the projecting strips 53 are disposed such that an axis L1 of a phantom cylinder thereby matches a straight line which bisects a space between the parallel portions 48 and circumferentially bisects the semi-circular arcuate portion 46. Inner ends of both the projecting strips 53 slightly protrude into the space between the parallel portions 48, and a gap 54 between both the projecting strips 53 extends into the semi-circular arcuate portion 46.

The seal member 44 comprises a U-shaped mounting portion 49 having a rectangular section, and a seal portion 50 connected to an outer peripheral portion of the mounting portion 49 and having a triangle section. The mounting portion 49 is mounted to the U-shaped groove 52 of the vane body 43, and the seal portion 50 protrudes from the U-shaped groove 52 to slide on the inner peripheral surface 45 by the semi-circular section B1 of the rotor chamber 14 and on the opposed inner end surfaces 47 by the rectangular section B2.

Figure 5:
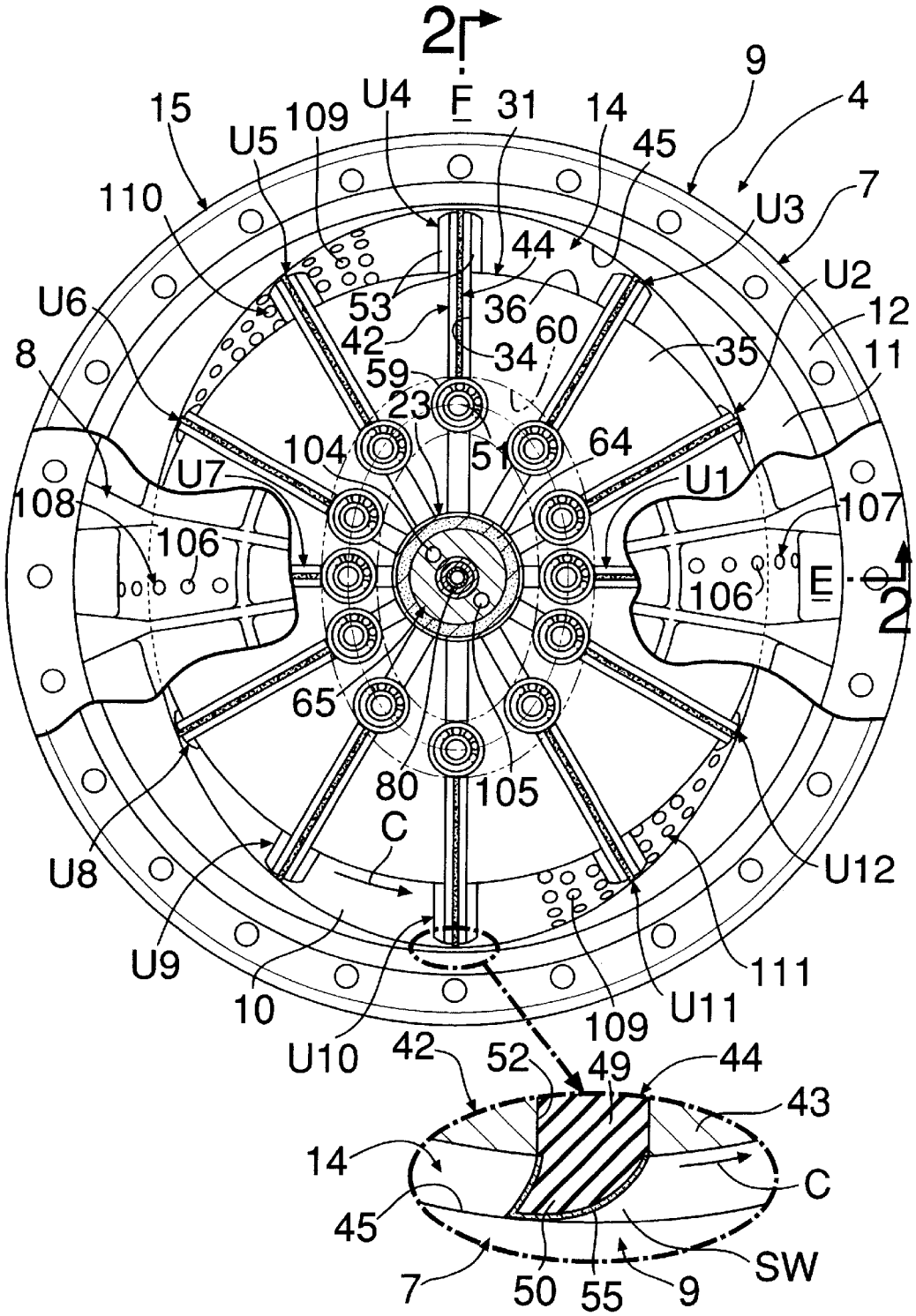
FIG. 5 is an enlarged sectional view of essential portions taken along a line 5—5 in FIG. 2.

As is shown, partially enlarged, in FIG. 5, the seal portion 50 is formed to be elastically deformable so as to slide on an inner surface of the casing 7 and thus the inner peripheral surface 45 and the opposed inner end surfaces 47, with the seal portion 50 bent backward of a rotational direction C of the rotor. The seal member 44 is basically made of heat-resisting synthetic rubber, and in the embodiment, a solid lubricating layer 55 is provided on a surface of the seal portion 50.

As the synthetic rubber, perfluoroelastomer is used, and the solid lubricating layer 55 is made of hard diamond-shaped carbon (DLC) film having a low coefficient of friction. The diamond-shaped carbon film used in this embodiment is a film such that in a laser Raman spectrum, a steep peak appears in either a graphite band of 1680 $cm^{-1}$ or a diamond band of 1370 $cm^{-1}$, and a significantly broad peak appears in the other, or significantly broad peaks appear in both the graphite band and the diamond band. This is according to "Evaluation of Diamond Film by Raman Spectroscopy", Jasco Report vol. 31, No. 3, 49–53 (1989), Yusei Okubo. The diamond-shaped carbon film is formed in an attached manner to the surface of the seal portion 50 by applying ion beam deposition to form the solid lubricating layer 55. When the seal portion 50 is bent as shown in FIG. 5, large numbers of micro cracks occur at random in the solid lubricating layer 55, so that the solid lubricating layer 55 is formed by an aggregate of a plurality of small pieces attached to the surface of the seal portion 50 in a spread manner. As a result, this allows elastic deformation of the seal portion 50 and provides good compliance with the inner peripheral surface 45 or the like. In this case, adhesion of each small piece to the seal portion 50 is high, and thus each piece does not fall off.

Each vane 42 is slidably held in each slot-shaped space 34 of the rotor 31, and at this time, both the projecting strips 53 of the vane body 43 are placed in the guide tube 40, and opposite sides of the projecting strips 53 are placed in both the slots e of the guide tube 40, respectively, so that inner end surfaces of both projecting strips 53 can abut against an outer end surface of the piston 41. Rollers 59 having a ball bearing structure are mounted to both the short shafts 51 of the vane body 43, and are respectively and turnably engaged with substantially oval annular grooves 60 formed on the opposed inner end surfaces 47 of the first and second half bodies 8, 9. As is clearly shown in FIG. 5, the oval shape of the annular groove 60 is similar to the oval shape of the rotor chamber 14. Thus, the roller 59 and annular groove 60 cooperate to keep a gap between the semi-circular arcuate portion 46 of the vane body 43 and the inner peripheral surface 45 of the rotor chamber 14 as well as gaps between the respective parallel portions 48 and the opposed inner end surfaces 47 of the rotor chamber 14 and reduce friction loss. These gaps are filled with the seal member 44 or kept at the minimum during a stop of rotation of the rotor 31, so that the gaps can be sealed from a start of rotation of the rotor 31 or immediately thereafter.

Figure 3:
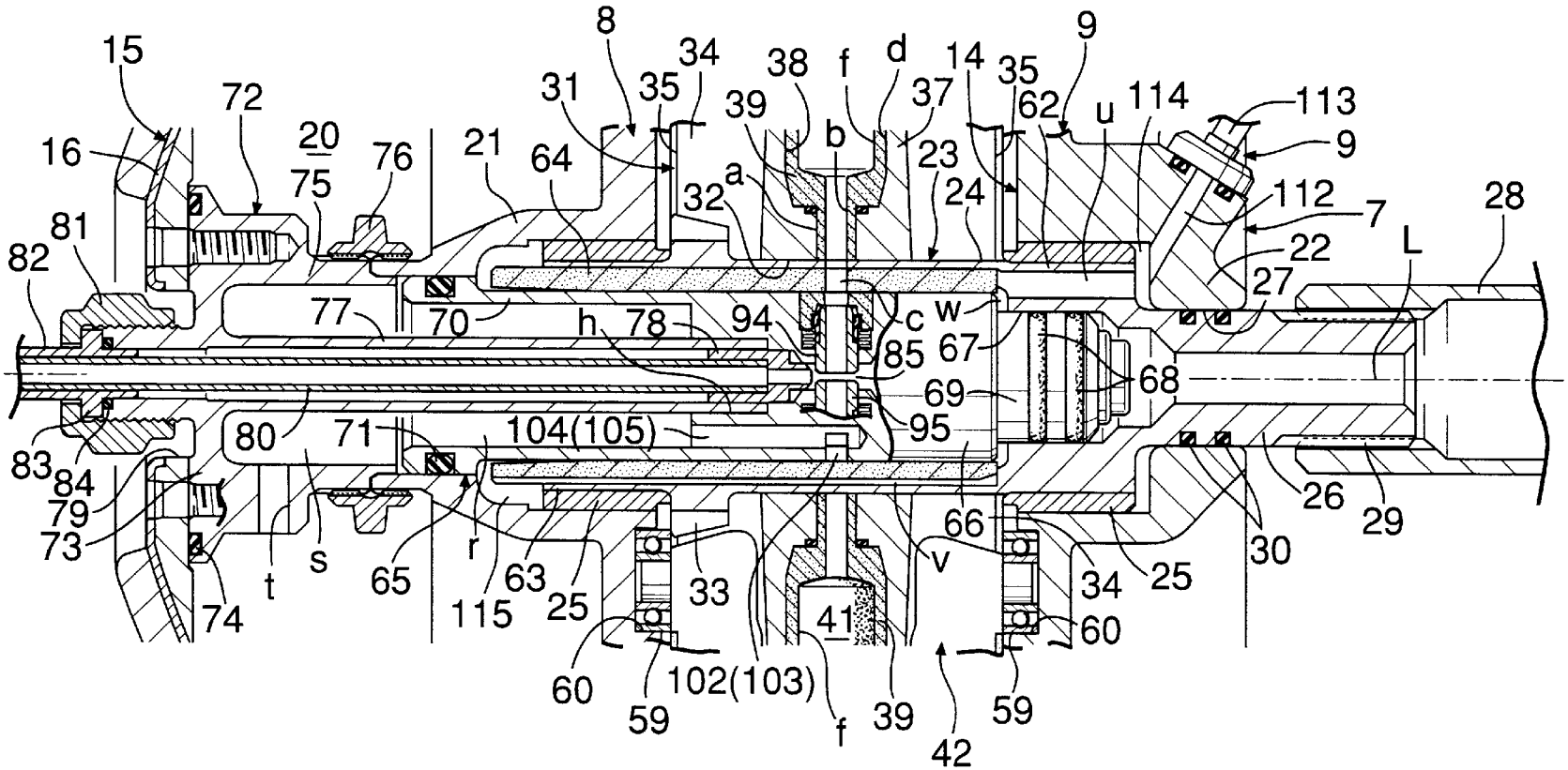
FIG. 3 is an enlarged sectional view of around a rotation axis in FIG. 2.

In FIGS. 2 and 3, the large diameter portion 24 of the output shaft 23 has a thick portion 62 supported by the bearing metal 25 of the second half body 9 and a thin portion 63 extending from the thick portion 62 and supported by the bearing metal 25 of the first half body 8. In the thin portion 63, a hollow shaft 64 made of ceramic is fitted so as to be rotated integrally with the output shaft 23. Inside the hollow shaft 64, a fixed shaft 65 is disposed and comprises a large diameter solid portion 66 fitted to the hollow shaft 64 so as to be fitted in an axial thickness of the rotor 31, a small diameter solid portion 69 fitted to a hole 67 at the thick portion 62 of the output shaft 23 via two seal rings 68, and a thin hollow portion 70 extending from the large diameter solid portion 66 and fitted in the hollow shaft 64. A seal ring 71 is interposed between an end outer peripheral surface of the hollow portion 70 and the inner peripheral surface of the hollow shaft receiving tube 21 of the first half body 8.

An end wall 73 of a hollow tube 72 coaxial with the output shaft 23 is mounted to at an inner surface of the central portion of the main body 16 of the shell-shaped member 15 via a seal ring 74. An inner end side of a short outer tube 75 extending inwards from an outer peripheral portion of the end wall 73 is coupled with the hollow shaft receiving tube 21 of the first half body 8 via a coupling tube 76. On the end wall 73, a long inner pipe 77 having a small diameter is provided so as to penetrate the same, and an inner end side of the inner pipe 77 is fitted to a stepped hole h at the large diameter solid portion 66 of the fixed shaft 65 together with a short hollow connection pipe 78 projecting therefrom. An outer end portion of the inner pipe 77 projects outwards from a hole 79 of the shell-shaped member 15, and an inner end side of an introduction pipe 80 for the raised-temperature/pressure vapor inserted from the outer end portion into the inner pipe 77 is fitted in the hollow connection pipe 78. A cap member 81 is screwed on the outer end portion of the inner pipe 77, and by the cap member 81, a flange 83 of a holder tube 82 for holding the introduction pipe 80 is fixed by pressure to the outer end surface of the inner pipe 77 via a seal ring 84.

As shown in FIGS. 2 to 4, and 12, the large diameter solid portion 66 of the fixed shaft 65 is provided with a mechanism which supplies the raised-temperature/pressure vapor to the cylinder member 39 of the first to twelfth vane-piston units U1 to U12 through a plurality of, in this embodiment, twelve, through-holes c successively formed on the hollow shaft 64 and the output shaft 23, and discharges a first dropped-temperature/pressure vapor after expansion from the cylinder member 39 through the through-holes c, as follows.

Figure 12:
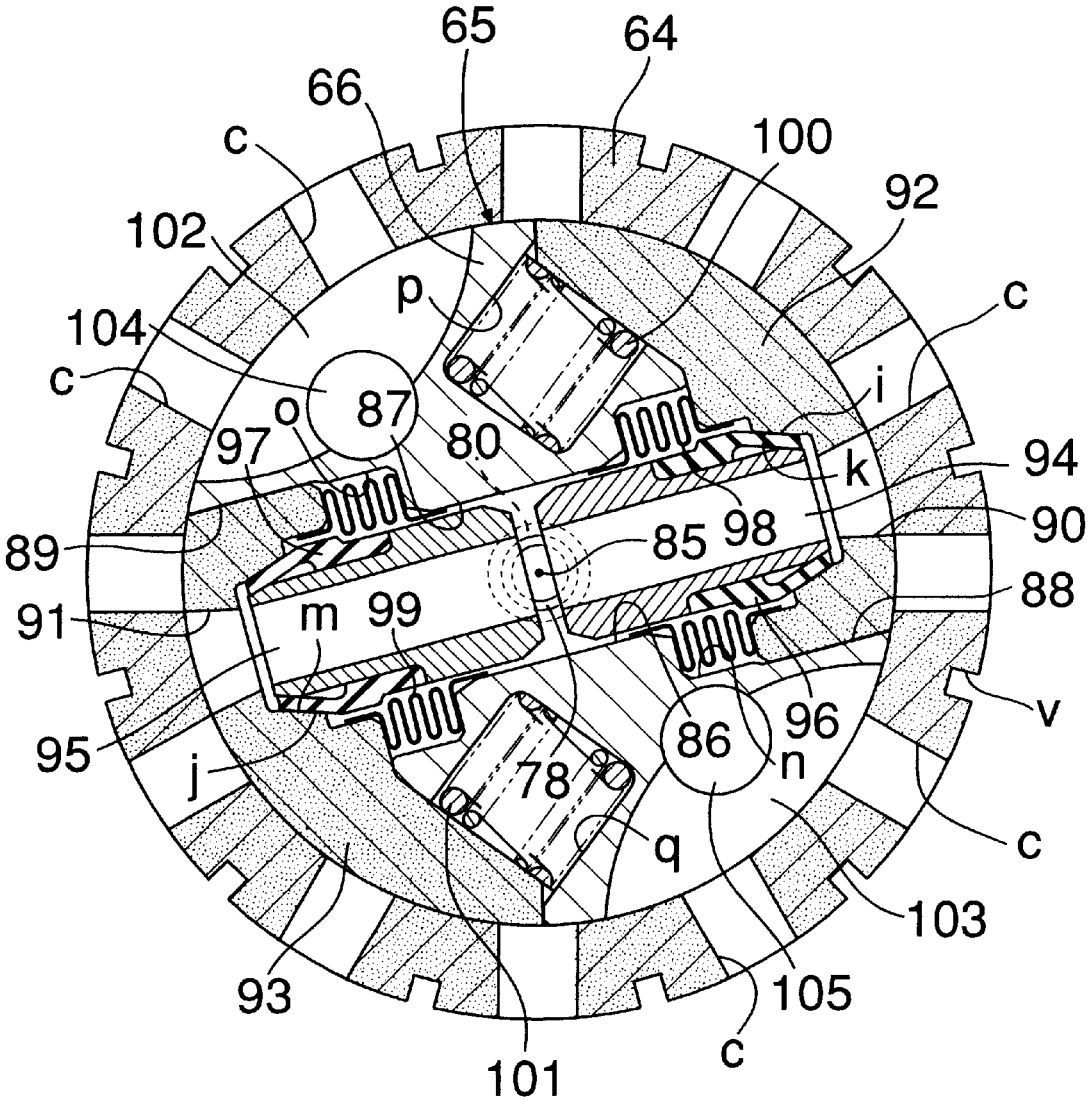
FIG. 12 is an enlarged view of a portion around a rotation axis in FIG. 4.

As is clearly shown in FIG. 12, in the large diameter solid portion 66, first and second holes 86, 87 extending in opposite directions to each other from a space 85 which communicates with the hollow connection pipe 78 are formed, and the first and second holes 86, 87 open into bottom surfaces of first and second recesses 88, 89 opening into the outer peripheral surface of the large diameter solid portion 66. First and second seal blocks 92, 93 made of carbon having supply ports 90, 91 are mounted to the first and second recesses 88, 89, and their outer peripheral surfaces are rubbed against the inner peripheral surface of the hollow shaft 64. In the first and second holes 86, 87, first and second supply pipes 94, 95 which are coaxial and short are inserted loosely, and taper outer peripheral surfaces i, j of first and second seal tubes 96, 97 fitted to tip side outer peripheral surfaces of the first and second supply pipes 94, 95 are fitted to inner peripheral surfaces of taper holes k, m inside the supply ports 90, 91 of the first and second seal blocks 92, 93 and connected thereto. The large diameter solid portion 66 is formed with first and second annular recesses n, o surrounding the first and second supply pipes 94, 95 and first and second blind-hole-shaped recesses p, q adjacent thereto so as to face the first and second seal blocks 92, 93, and first and second bellows-shaped elastic body 98, 99 are respectively accommodated in the first and second annular recesses n, o, and first and second coil springs 100, 101 are respectively fitted in the first and second blind-hole-shaped recesses p, q, and the first and second seal blocks 92, 93 are pressed against the inner peripheral surface of the hollow shaft 64 by spring forces of the first and second bellows-shaped elastic body 98, 99 and the first and second coil springs 100, 101.

In the large diameter solid portion 66, formed between the first coil spring 100 and second bellows-shaped elastic body 99, and between the second coil spring 101 and the first bellows-shaped elastic body 98 are first and second recess-shaped discharge portions 102, 103 always communicating with two through-holes c and first and second discharge bores 104, 105 extending from the discharge portions 102, 103 in parallel with the introduction pipe 80 and opening into a hollow portion r of the fixed shaft 65.

The members such as the first seal block 92 and second seal block 93 which are of the same kind and given a word "first" and a word "second" are in a point symmetrical relationship with respect to the axis of the fixed shaft 65.

There is a passage s of the first dropped-temperature/pressure vapor in the hollow portion r of the fixed shaft 65 and in the outer tube 75 of the hollow tube 72, and the passage s communicates with the expansion chamber 20 via a plurality of through-holes t penetrating a peripheral wall of the outer tube 75.

As shown in FIGS. 2 and 5, in the outer peripheral portion of the main body 11 of the first half body 8, formed around opposite ends of the short diameter of the rotor chamber 14 are first and second introduction hole groups 107, 108 formed of a plurality of introduction holes 106 aligned in the radial directions, and a second dropped-temperature/pressure vapor with temperature and pressure dropped in the expansion chamber 20 is introduced into the rotor chamber 14 from the introduction hole groups 107, 108. In the outer peripheral portion of the main body 11 of the second half body 9, formed between an end of the long diameter of the rotor chamber 14 and the second introduction hole group 108 is a first leading hole group 110 formed of a plurality of leading holes 109 aligned in the radial and peripheral directions, and formed between the other end of the long diameter and the first introduction hole group 107 is a second leading hole group 111 formed of a plurality of leading holes 109 aligned in the radial and peripheral directions. From the first and second leading hole groups 110, 111, a third dropped-temperature/pressure vapor with further dropped temperature and pressure is discharged outside by expansion between the adjacent vanes 42.

The output shaft 23 or the like is lubricated by water, and the lubricating passage is formed as follows. That is, as shown in FIGS. 2 and 3, a water supply pipe 113 is connected to a water supply hole 112 formed in the hollow shaft receiving tube 22 of the second half body 9. The water supply hole 112 communicates with a housing 114 which the bearing metal 25 of the second half body 9 side faces, the housing 114 communicates with a water passing hole u formed in the thick portion 62 of the output shaft 23, the water passing hole u communicates with a plurality of water passing grooves y extending in a generatrix direction of the outer peripheral surface of the hollow shaft 64 (see also FIG. 12), and further each water passing groove v communicates with a housing 115 which the bearing metal 25 of the second half body 8 side faces. An inner end surface of the thick portion 62 of the output shaft 23 is provided with an annular recess w which communicates the water passing hole u to a slide portion between the hollow shaft 64 and the large diameter solid portion 66 of the fixed shaft 65.

This causes lubrication between each bearing metal 25 and the output shaft 23, and between the hollow shaft 64 and fixed shaft 65 by water, and lubrication among the casing 7 and the seal member 44 and each roller 59 by water having permeated the rotor chamber 14 from the space between the bearing metals 25 and the output shaft 23.

Figure 4:
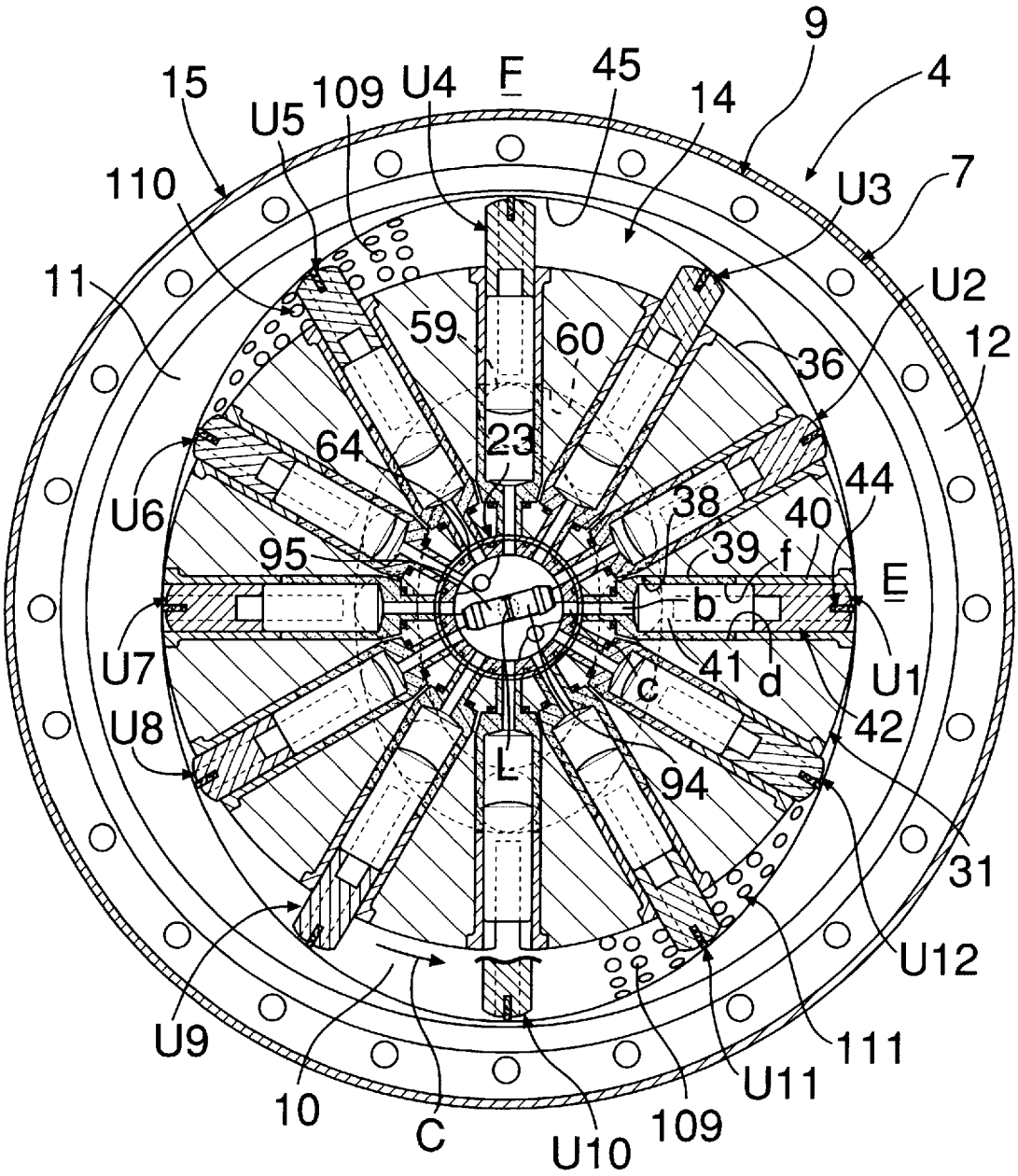
FIG. 4 is a sectional view taken along a line 4—4 in FIG. 2.

In FIG. 4, the first and seventh vane-piston units U1, U7 in a point symmetrical relationship with respect to the rotation axis L of the rotor 31 operate in the same way. This applies to the second and eighth vane-piston units U2, U8 in the point symmetrical relationship.

For example, also referring to FIG. 12, an axis of a first supply pipe 94 is slightly deviated in a counterclockwise direction with respect to a short diameter position E of the rotor chamber 14 in FIG. 4, the first vane-piston unit U1 is located in the short diameter position E and the raised temperature/pressure vapor is not supplied to the large diameter cylinder hole f, and therefore it is assumed that the piston 41 and vane 42 are located in a backward position.

From this condition, if the rotor 31 is slightly rotated in the counterclockwise direction in FIG. 4, that is, in a rotational direction C of the rotor, the supply port 90 of the first seal block 92 communicates with the through-hole c, and the raised-temperature/pressure vapor from the introduction pipe 80 is introduced in the large diameter cylinder hole f through a small diameter hole b. This causes forward motion of the piston 41, and since the vane 42 slides toward the long diameter position F of the rotor chamber 14, the forward motion is converted to rotary motion of the rotor 31. When the through-hole c is deviated from the supply port 90, the raised-temperature/pressure vapor expands in the large diameter cylinder hole f to further move forward the piston 41, and thus the rotation of the rotor 31 is continued. The expansion of the raised-temperature/pressure vapor ends when the first vane-piston unit U1 reaches the long diameter position F of the rotor chamber 14. Then, by the piston 41 moved backward by the vane 42, the first dropped-temperature/pressure vapor in the large diameter cylinder hole f is discharged to the expansion chamber 20 through a small diameter hole b, through-hole c, first recess-shaped discharge portion 102, first discharge bore 104, passage s (see FIG. 3), and each through-hole t with the rotation of the rotor 31. In the expansion chamber 20, the second dropped-temperature/pressure vapor whose temperature and pressure are reduced by further expansion is then introduced into the rotor chamber 14 through the first introduction hole group 107, as shown in FIGS. 2 and 5, and further expands between the adjacent vanes 42 to rotate the rotor 31, and then the third dropped-temperature/pressure vapor is discharged outwards from the first leading hole group 110.

In this way, by operating the piston 41 by the expansion of the raised temperature/pressure vapor to rotate the rotor 31 via the vane 42, and by rotating the rotor 31 via the vane 42 by the expansion of the dropped-temperature/pressure vapor caused by a pressure reduction in the raised-temperature/pressure vapor, an output can be obtained by the output shaft 23.

The seal portion 50 of the each vane 42 is formed to be elastically deformable to slide on the inner peripheral surface 45 and the opposed inner end surfaces 47 of the rotor chamber 14 with the seal portion 50 bent as described above, so that the seal portion 50 is elastically deformed to fit shapes of a minute recess and projection or a minute step by the first and second half bodies 8, 9, even if they exist on the inner peripheral surface 45 or the like, thereby securing sealing performance between the seal portion 50 and the inner peripheral surface 45 of the rotor chamber 14. On the other hand, sealing performance between the U-shaped groove 52 of the vane body 43 and the mounting portion 49 of the seal member 44 is secured by elasticity of the mounting portion 49.

Figure 13:
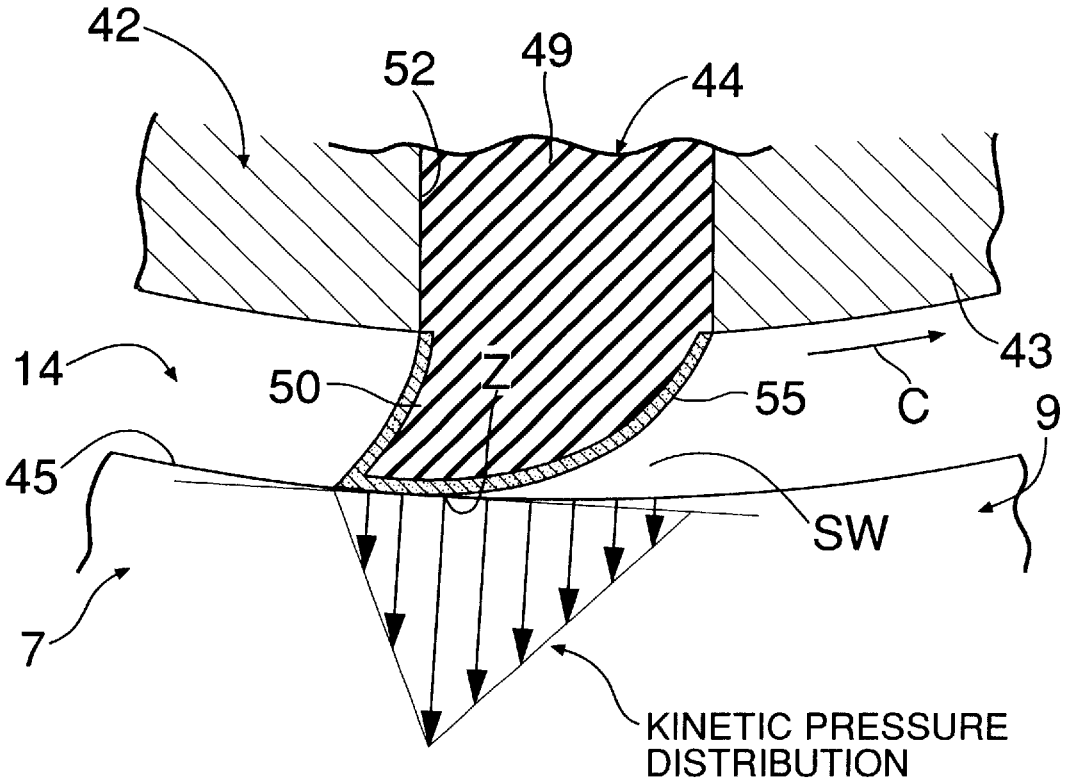
FIG. 13 illustrates a configuration and kinetic pressure distribution of the seal portion during rotation of the rotor.

As shown in FIG. 13, during high speed rotation of the rotor 31, a kinetic pressure in a wedge-shaped space SW formed between a front surface of the seal portion 50 in a rotational direction C of the rotor, in the embodiment, the surface of the solid lubricating layer 55, and the inner peripheral surface 45 of the rotor chamber 14 is increased, and the kinetic pressure is further increased by an increased amount of deformation of the seal portion 50 by the centrifugal force. The increased kinetic pressure becomes a pressing force of the seal portion on the inner peripheral surface 45 of the rotor chamber, and a pressure acting on a tip of the seal portion 50 is reduced since a point of application Z of the pressing force is displaced closer to a base rather than the tip of the seal portion 50 by deformation thereof. This restrains an increase in the surface pressure of the seal portion 50, and reduces a heating value due to sliding to significantly improve durability of the seal portion 50. When the value of the kinetic pressure in the wedge-shaped space SW is higher than a design value, the seal portion 50 is significantly deformed to release an excess of the kinetic pressure, thereby keeping the kinetic pressure in the wedge-shaped space SW substantially constant.

Further, even if fluttering occurs in the seal portion 50, the surface pressure of the seal portion 50 can be reduced by vibration damping effect due to bending. Thus, even if the solid lubricating layer 55 made of the hard diamond-shaped carbon film exists on the surface of the seal portion 50, streaked sliding marks cannot occur on the inner peripheral surface 45 and the opposed inner end surfaces 47 of the rotor chamber 14.

Furthermore, when the seal member 44 is made of the synthetic rubber described above, the coefficient of friction is relatively high, and sometimes the seal member 44 is disengaged from the U-shaped groove 52 of the vane body 43 or cracks occur on the seal member 44 depending on sliding conditions. Providing the solid lubricating layer 55 having a low coefficient of friction on the seal portion 50 ensures avoiding occurrence of the defect described above.

Figure 14:
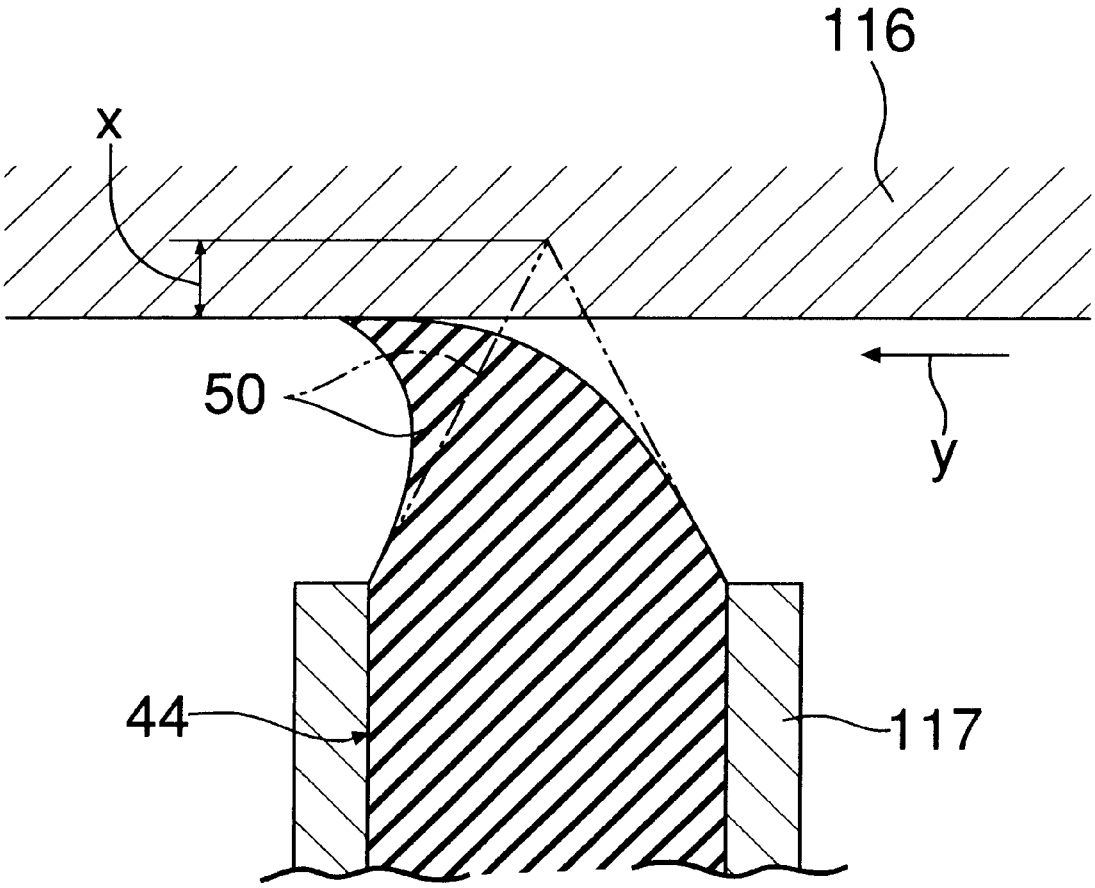
FIG. 14 illustrates a method of a sliding test.

Next, a sliding test was conducted for the seal member 44, and a relationship between the amount of bending x and the coefficient of friction $\mu$ of the seal portion 50 was tested. FIG. 14 illustrates a method of the sliding test as described below. Specifically, the seal portion 50 of the seal member 44 held by a holder 117 corresponding to the vane body 43 is pressed on a flat plate 116 corresponding to the casing 7 from below with a predetermined load, and then the flat plate 116 is slid in one direction at a predetermined speed as shown by an arrow y. This test was conducted for the seal portion 50 with the solid lubricating layer 55 and the seal portion 50 without the solid lubricating layer 55 in the water, i.e. in a wet condition, and in the air, i.e. in a dry condition. In this case, the flat plate 116 was made of stainless steel of JIS SUS316, and the holder 117 was made of stainless steel of JIS SUS304. The seal member 44 was made of the above described perfluoroelastomer, and the solid lubricating layer 55 was made of the diamond-shaped carbon film of about 1 $\mu$m thick. Sliding speed of the flat plate 116 was set to 0.5 m/s, and a pressing load on the seal portion 50 was adjusted within a range of 0.3 to 3 kgf in accordance with the amount of bending x.

Figure 15:
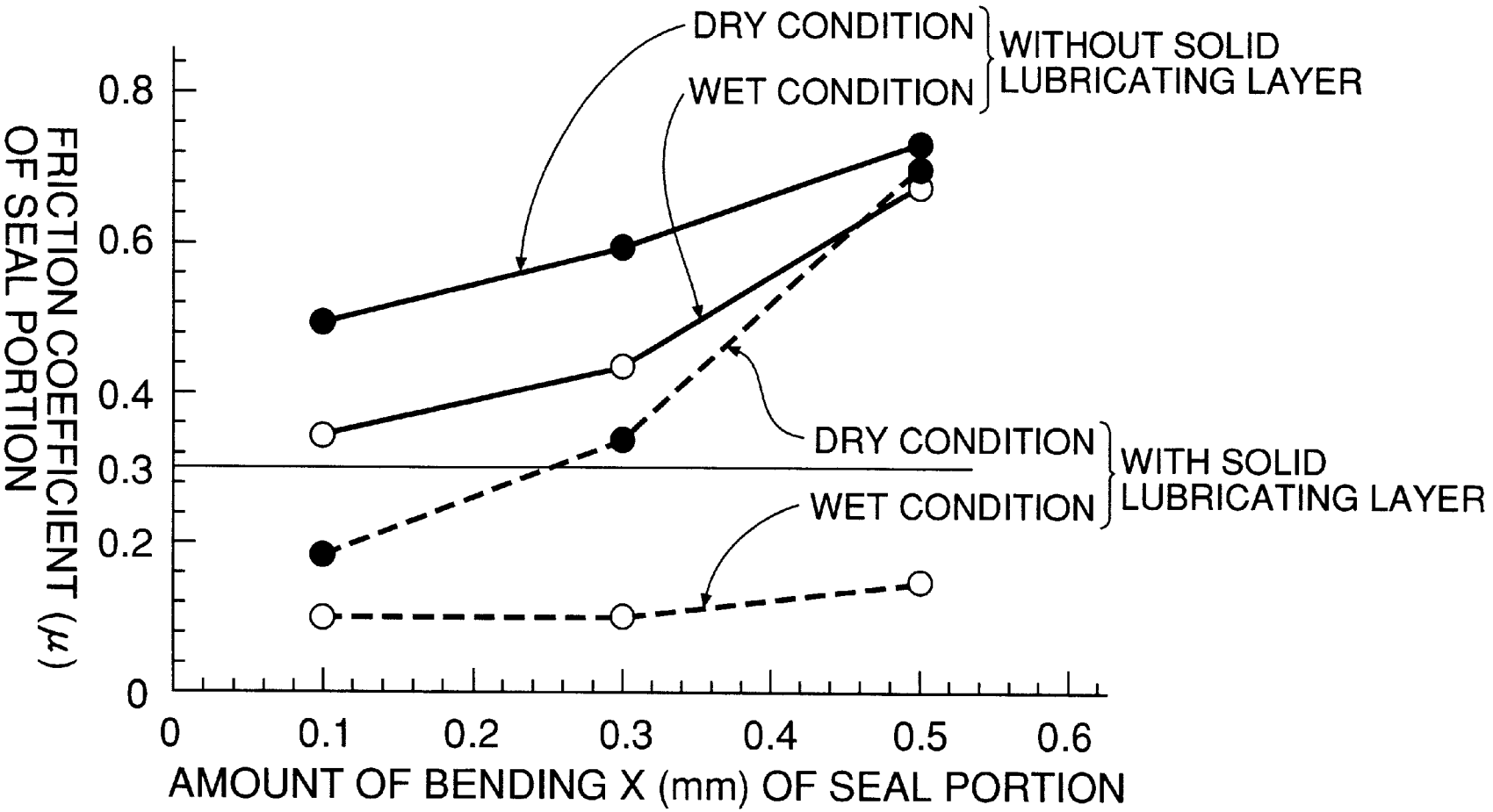
FIG. 15 is a graph illustrating a relationship between an amount of bending x and a friction coefficient $\mu$ of the seal portion.

FIG. 15 illustrates test results. As can be seen from FIG. 15, when the solid lubricating layer 55 is provided on the surface of the seal portion 50, the seal portion 50 has a lower coefficient of friction $\mu$ in both of the dry and wet conditions, compared to the case without the solid lubricating layer 55. A preferable coefficient of friction $\mu$ of the seal portion 50 is $\mu \leqq 0.3$, and for obtaining this value, the amount of bending x of the seal portion 50 is set to $x \leqq 0.24$ mm in the dry condition, and $x \leqq 0.5$ mm in the wet condition in this embodiment.

Figure 16B:
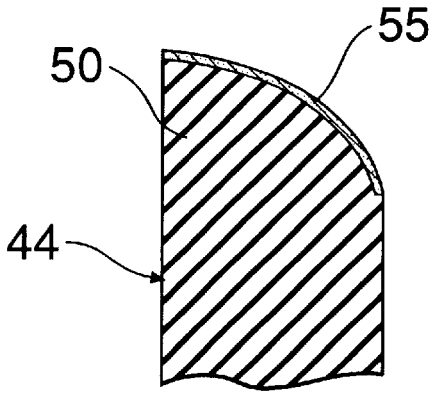
FIG. 16A to FIG. 16D are sectional views of seal portions having various shapes.
Figure 16A:
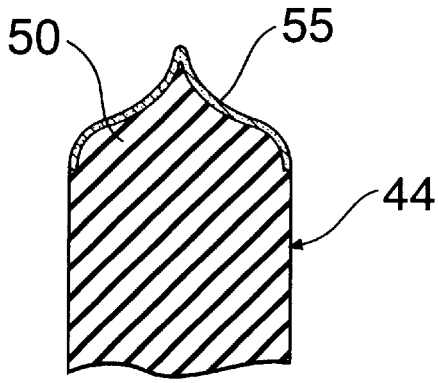
Figure 16D:
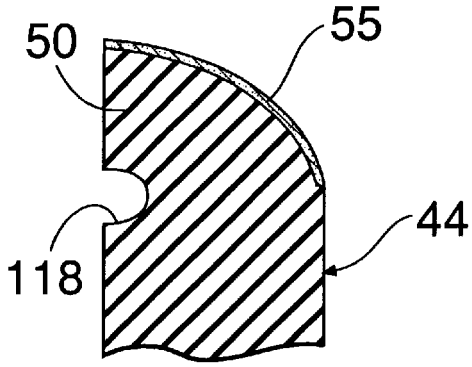
Figure 16C:
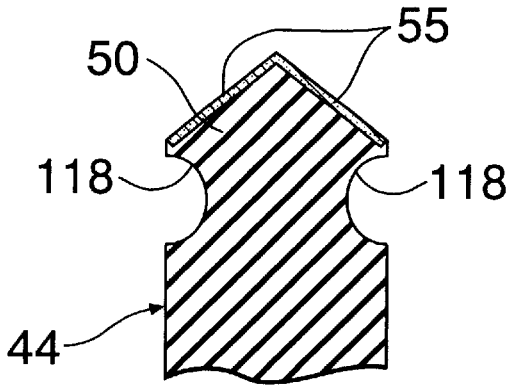

The shape of the seal portion 50 is not limited to the triangle section, but various shapes can be applied as shown in FIG. 16A to FIG. 16D. FIG. 16A shows a funnel-shaped section, FIG. 16B shows a blade-shaped section, FIG. 16C shows a triangle section with notches 118 on its both edges for facilitating bending of the seal portion 50, and FIG. 16D shows a blade-shaped section with a similar notch 118 on its ridge.

When the expander 4 is used as a compressor, the rotor 31 is turned clockwise in FIG. 4 by the output shaft 23, outside air as fluid is sucked into the rotor chamber 14 from the first and second leading hole groups 110, 111 by the vane 42, low compressed air thus obtained is fed from the first and second introduction hole group 107, 108 through the expansion chamber 20, each through-hole t, passage s, first and second discharge bores 104, 105, first and second recess-shaped discharge portions 102, 103, and the through-hole c to the large diameter cylinder hole f, the piston 41 is actuated by the vane 42 to convert the low compressed air to high compressed air, and the high compressed air is introduced in the introduction pipe 80 through the through-hole c, supply ports 90, 91 and first and second supply pipes 94, 95.

Figure 17:
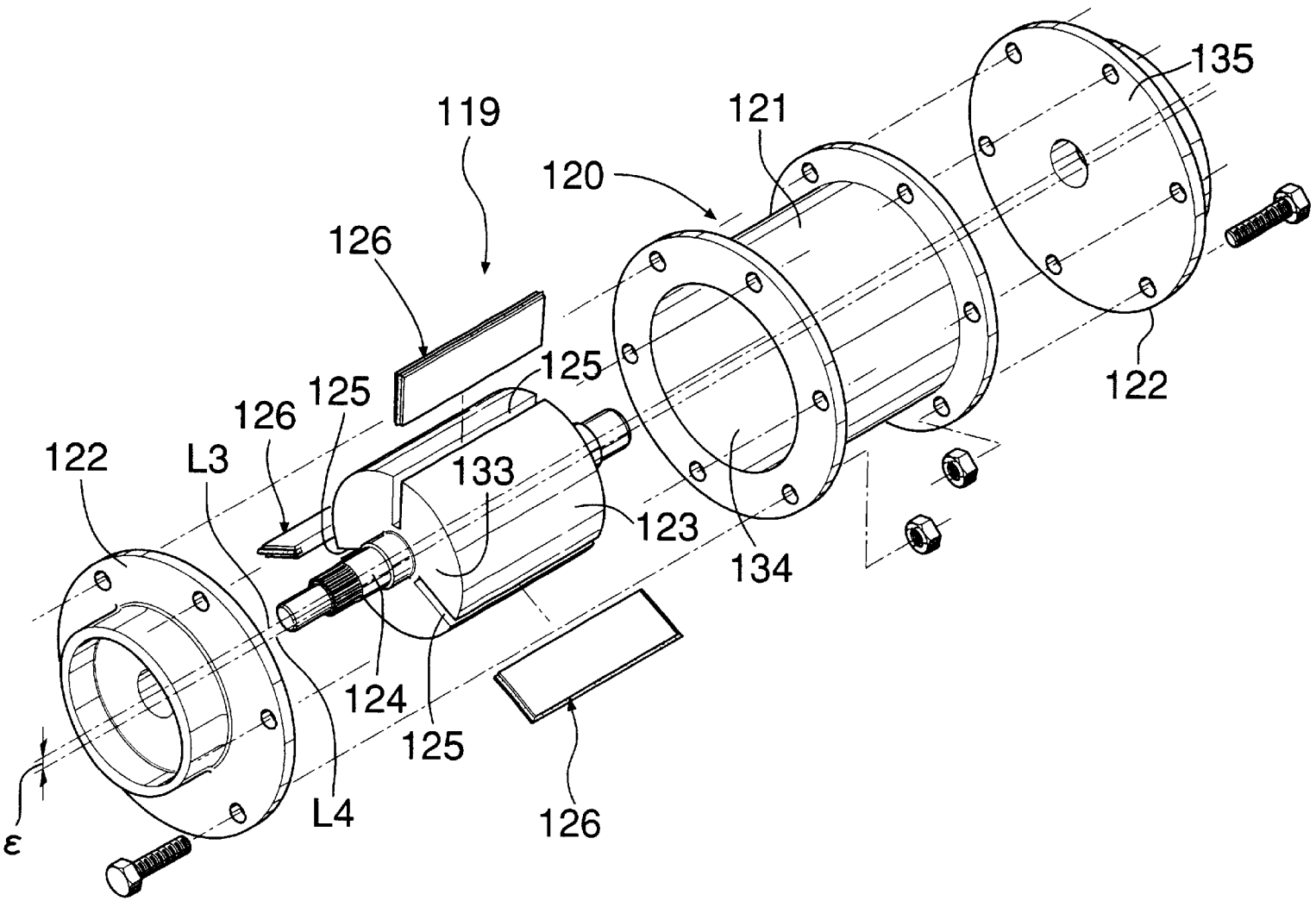
FIG. 17 is an exploded perspective view of a vane pump.
Figure 18:
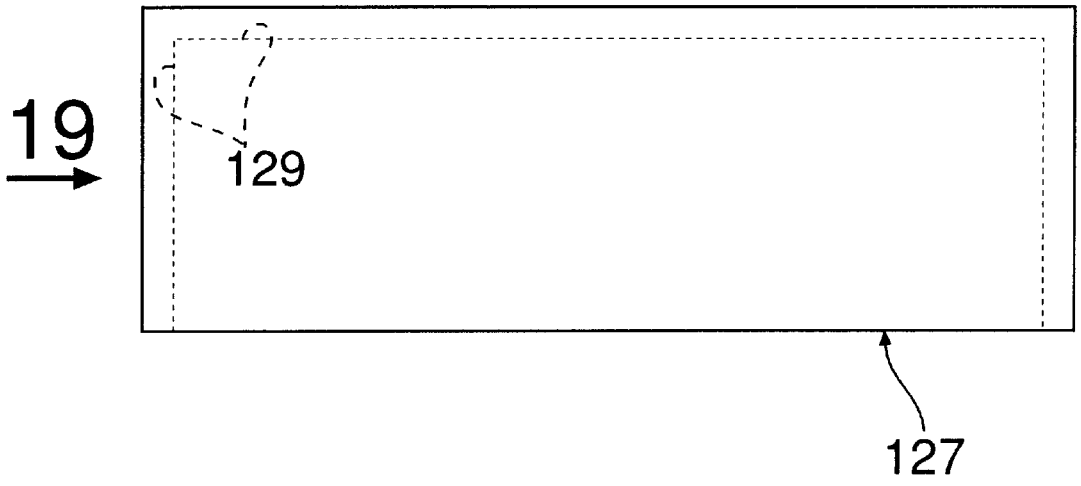
FIG. 18 is a front view of a vane body.
Figure 19:
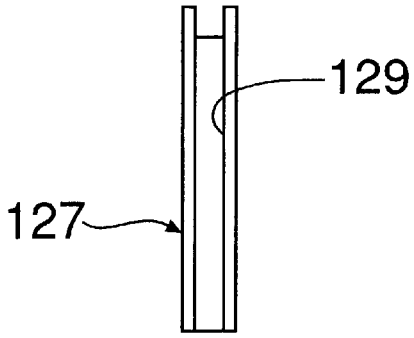
FIG. 19 is a view taken in the direction of an arrow 19 in FIG. 18.
Figure 20:
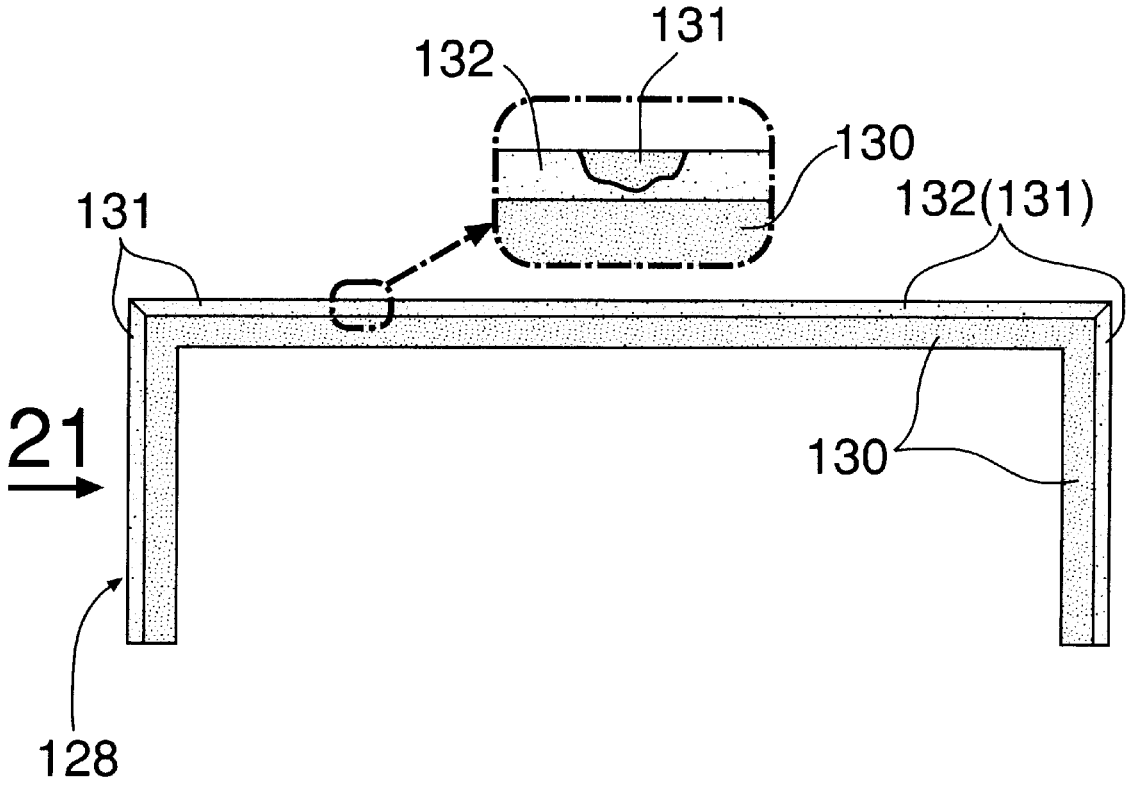
FIG. 20 is a front view, partially enlarged and cutaway, of a seal member.
Figure 21:
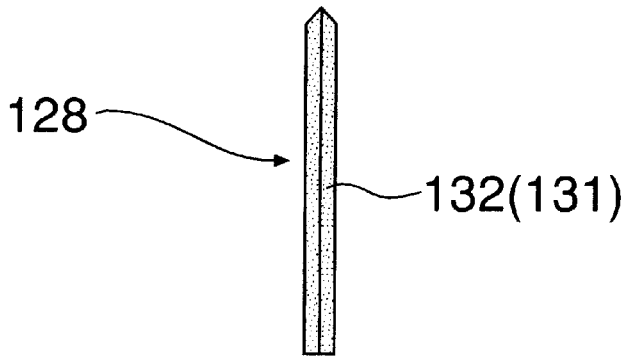
FIG. 21 is a view taken in the direction of an arrow 21 in FIG. 20.

FIG. 17 shows a vane pump 119 as a vane type fluid machine. casing 120 thereof comprises a cylindrical casing body 121 and two annular end plates 122 provided on opposite ends of the casing body 121. The casing 120 accommodates a cylindrical rotor 123, and an axis L3 of a rotation axis 124 of the rotor 123 is deviated by $\epsilon$ from the center line L4 of the casing 120. The rotor 123 has three vane grooves 125 formed at even intervals on the circumference, and vanes 126 that slide on an inner surface of the casing, i.e., an inner peripheral surface 134 of the casing body 121 and inner surfaces 135 of both end plates 122 are slidably fitted into the vane grooves 125.

As shown in FIGS. 18, 19 and FIGS. 20, 21, each vane 126 comprises a vane body 127 and a seal member 128 made of heat-resisting synthetic rubber and provided on the vane body 127. The vane body 127 is in the form of a flat plate, and over its long edge and opposite short edges, a sequential rectangular U-shaped groove 129 is formed. The seal member 128 has a rectangular U-shaped mounting portion 130 mounted to the rectangular U-shaped groove 129 of the vane body 127, and a seal portion 131 connected to an outer peripheral portion of the mounting portion 130. Similarly to the above description, the mounting portion 130 has a rectangular section, and the seal portion 131 has a triangle section. On a surface of the seal portion 131, a solid lubricating layer 132 having large numbers of micro cracks are similarly provided to allow elastic deformation of the seal portion 131. As a heat-resisting synthetic rubber, perfluoroelastomer is likewise used, and the solid lubricating layer 132 is likewise formed of diamond-shaped carbon film.

A usual vane pump is provided with a predetermine gap between an end surface 133 of the rotor 123 and an inner surface 135 of the end plate 122 opposing the end surface 133 in view of heat expansion of the rotor 123 during operation. However, when the seal member 128 described above is used, the gaps can be filled with the seal member 128 or kept at the minimum during a stop of rotation of the rotor 123, so that the gaps can be sealed from a start of rotation of the rotor 123 or immediately thereafter.

INDUSTRIAL APPLICABILITY

The present invention may be applied to a vane type fluid machine other than the expander, such as a vane motor, blower, or vane compressor.

We claim:

1. A vane type fluid machine, comprising a casing;

a rotor rotating in the casing;

a plurality of vanes supported by the rotor to slide on an inner surface of the casing, and a supply mechanism for supplying a high temperature fluid as an operating medium, wherein a seal portion of each vane is formed to be elastically deformable so as to slide on said inner surface of the casing while bending backward of a rotational direction of the rotor, wherein said seal portion of each vane is made of heat-resisting synthetic rubber, wherein a solid lubricating layer is provided on a surface of said seal portion of each vane, and wherein said solid lubricating layer is formed by an aggregate of a plurality of small pieces attached to the surface of said seal portion in a spread manner.

2. A vane type fluid machine according to claim 1, wherein said solid lubricating layer is formed of diamond-shaped carbon film.

3. A vane type fluid machine according to claims 1 or 2, wherein said vane body is in the form of either a U-shaped plate or a flat plate, said seal member comprises: a mounting portion mounted to said vane body and having either a U shape or a rectangular U shape; and said seal portion connected to an outer peripheral portion of the mounting portion.

4. A vane type fluid machine according to claim 1 or 2, wherein said high temperature fluid is a high temperature steam.

5. A vane type fluid machine according to claim 4, wherein said high temperature steam is a high temperature water vapor.

6. A vane type fluid machine according to claim 1, wherein said casing has an inner peripheral surface on which a recess and a projection are formed.

7. A vane type fluid machine according to claim 6, wherein said casing comprises a plurality of casing elements and said recess and projection are formed by mating surfaces of said plurality of casing elements.

8. A vane type fluid machine according to claim 7, wherein said vane body is in the form of either a U-shaped plate or a flat plate, said seal member comprises: a mounting portion mounted to said vane body and having either a U shape or a rectangular U shape; and said seal portion connected to an outer peripheral portion of the mounting portion.

* * * * *